US005474143A

United States Patent [19]

Majkovic

[11] Patent Number: 5,474,143

[45] Date of Patent: Dec. 12, 1995

[54] DRILL BIT REAMER STABILIZER

[75] Inventor: Davor Majkovic, Edmonton, Canada

[73] Assignee: Smith International Canada, Ltd., Canada

[21] Appl. No.: 248,644

[22] Filed: May 25, 1994

[51] Int. Cl.[6] ..... E21B 17/10; E21B 17/22

[52] U.S. Cl. ..... 175/323; 175/325.2; 175/325.4

[58] Field of Search ..... 175/323, 325.4, 175/325.2, 325.1, 325.5

[56] References Cited

U.S. PATENT DOCUMENTS

| | | | |
|---|---|---|---|
| 1,454,048 | 5/1923 | Esperson . | |
| 2,589,534 | 3/1952 | Buttolph | 255/28 |
| 3,285,678 | 11/1966 | Garret et al. | 308/4 |
| 3,419,094 | 12/1968 | Bobo | 175/325 |
| 3,916,998 | 11/1975 | Bass et al. | 166/301 |
| 3,945,446 | 3/1976 | Ostertag et al. | 175/323 |
| 3,978,933 | 9/1976 | Olson et al. | 175/325.2 |
| 4,011,918 | 3/1977 | Jurgens | 175/325.2 |
| 4,385,669 | 5/1983 | Knutsen | 175/323 |
| 4,467,879 | 8/1984 | Burge | 175/325.4 |
| 4,610,316 | 9/1986 | Boaz | 175/323 |
| 4,664,206 | 5/1987 | Butler | 175/325 |
| 4,694,918 | 9/1987 | Hall | 175/430 |
| 4,811,800 | 3/1989 | Hill et al. | 175/323 |
| 4,874,045 | 10/1989 | Clayton | 175/57 |

FOREIGN PATENT DOCUMENTS

| | | | |
|---|---|---|---|
| 832025 | 5/1981 | U.S.S.R. | 175/325.4 |
| 1348487 | 10/1987 | U.S.S.R. | 175/325.4 |

*Primary Examiner*—Hoang C. Dang
*Attorney, Agent, or Firm*—Banner & Allegretti, Ltd.

[57] ABSTRACT

A drill bit reamer stabilizer has an upper and lower stabilizer on a bottom hole assembly with the lower stabilizer as close as possible to the drill bit. This arrangement reduces deviations when drilling a straight hole. Furthermore there is a reamer portion at the leading edge of the lower stabilizer to ensure the drilled hole is reamed out to the nominal drill bit size regardless of drill bit wear. The assembly has a longitudinal shaft with a shank on a top end for connection to a drilling string, an internally threaded box in a bottom end of the shaft for connection to the drill bit, the internally threaded box having an internally tapered lip to overlap a drill bit shank. The lower stabilizer has spiral flutes and lands adjacent the bottom end of the shaft, the flutes have polycrystalline diamond layer inserts at the leading edge of the stabilizer to provide a reamer, the inserts ream a hole substantially the same size as the nominal size of the drill bit.

6 Claims, 2 Drawing Sheets

DRILL BIT REAMER STABILIZER

TECHNICAL FIELD

The present invention relates to well drilling and more specifically to a combined reamer and stabilizer assembly for a drill bit.

BACKGROUND ART

Rotary drilling of oil wells and the like uses a drill bit, sometimes referred to as a rock bit, which is generally of the cone roller bearing type and may have tungsten carbide teeth or diamond bit inserts. The drill bits are generally made to a nominal diameter for cutting a hole. However, even this nominal diameter need not be precise and can have a tolerance depending on the type of drill bit of up to ±¼ inch. The diameter of the drill bits are generally measured by conventional ring gauges. When drilling, wear takes place in the conical teeth of the drill bit regardless of the material. Thus when drilling a hole, the drill bit wears and thus the diameter of the drilled hole is reduced.

In the past it was found that in order to ensure a straight drill hole or to at least control the direction and angle of a drill hole, it was necessary to include a stabilizer. Stabilizers are positioned above the drill bit to ensure that the drill bit and stabilizer assembly drill a straight hole or else drill at an angle or curve that is determined by differences in diameter between the drill bit and the stabilizer. An example of straight hole drilling is shown in U.S. Pat. No. 4,874,045.

Stabilizers, whether a single stabilizer at the bottom of the stabilizer assembly or multiple stabilizers, generally all comprise spiral flutes and lands which are formed out of hardened carbon steel and are often integral with a bottom hole assembly in the form of a shaft with a tong arm neck above the lower stabilizer used to grip the assembly at the drill head for changing drill bits. It has been found that as that drill bit wears during drilling, the drilled hole reduces in diameter and at the same time the lands of the stabilizer which generally start off at being the nominal drill size being used, wear about the same amount otherwise they can become jammed in the hole. Thus, the drilled hole is smaller in diameter at the bottom than the nominal drill size or starting size.

When drilling deep holes it is often necessary to change drill bits. This is done by raising the drill string, gripping the bottom hole assembly around the tong arm neck and then removing the old drill bit and inserting a new drill bit. However, when the drill bit is lowered in the drill hole, as it gets closer to the bottom on the hole, it tends to jam as the hole is undersized. Thus, it has to be redrilled in order to increase hole size to the nominal size and this results in considerably more drilling time. Furthermore, at this stage, unless one has replaced the bottom hole assembly, the stabilizer is worn to a smaller diameter than the nominal drill size and this can result in not drilling a straight hole.

In most bottom hole assemblies, there is generally some distance between the drill bit and the stabilizer which can result in deviation from a straight drilled hole. If the stabilizer does not wear to the same extent as the drill bit then it acts to attempt to ream out the drill hole and this can cause the stabilizer to hang up or jam in an undersized hole.

Disclosure of Invention

It is an aim of the present invention to provide a combined reamer and stabilizer assembly for a drill bit that has a reamer and stabilizer unit placed as close as possible to the drill bit to minimize deviation in straight drilling, and which has a reamer with the stabilizer that reams out an undersized drill hole should the drill bit wear, to ensure that the drill hole remains at the full gauge or nominal drill bit size.

If hardened steel stabilizers are used, the cutting edges of the lands tend to wear and therefore in order to provide a long lasting reamer the lands are fitted with polycrystalline diamond layer inserts. Examples of such inserts are shown in U.S. Pat. Nos. 4,604106 and 4,694,918. It is known that the polycrystalline diamond material is more wear resistant than tungsten carbide by a factor of over 1,000, thus by utilizing these diamond inserts in the lands of a stabilizer, one is able to provide a combined reamer and stabilizer assembly which is long lasting.

The present invention provides a combined reamer and stabilizer assembly for a drill bit having a nominal size comprising: a longitudinal shaft with a shank on a top end for connection to a drilling string, an internally threaded box in a bottom end of the shaft for connection to the drill bit, the internally threaded box having an internally tapered lip to overlap a drill bit shank, and a lower stabilizer having spiral flutes and lands adjacent the bottom end of the shaft, the spiral lands having polycrystalline diamond layer inserts at a leading edge of the stabilizer to provide a reamer, the inserts adapted to ream a hole substantially the same size as the nominal size of the drill bit.

BRIEF DESCRIPTION OF DRAWINGS

In drawings which illustrate embodiments of the present invention.

BEST MODE FOR CARRYING OUT THE INVENTION

Figure 1:
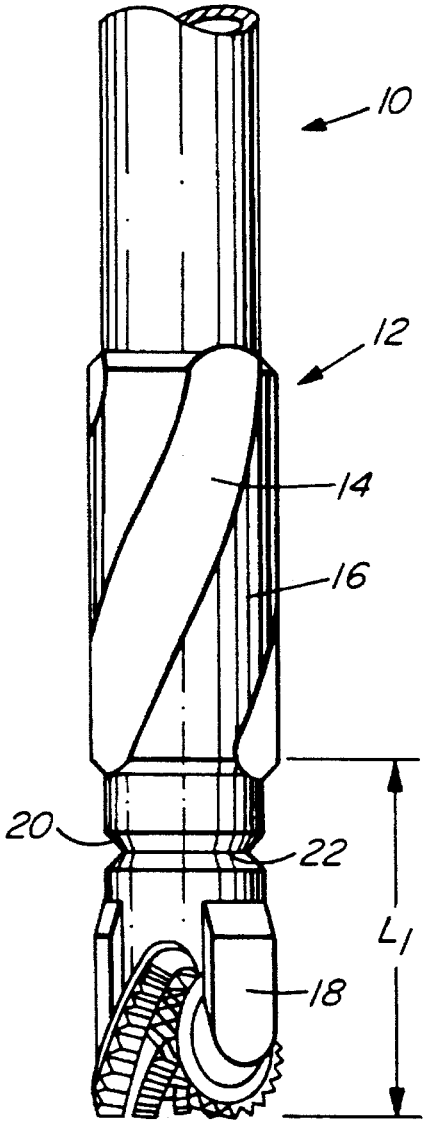
FIG. 1 PRIOR ART
FIG. 1 is an elevational view showing a drill bit assembly and stabilizer assembly of the type known in the prior art.

A portion of a bottom hole assembly 10 of the type known in the prior art is shown in FIG. 1 which has a lower stabilizer 12 with outstanding spiral lands 14 and recessed spiral flutes 16. A drill bit 18 is shown attached to the bottom end 20 of the assembly 10 and as can be seen, the connection 22 where the drill bit 18 joins the assembly 10 has a notch therein, thus the shank of the drill bit 18 at the join 22 is exposed.

Figure 2:
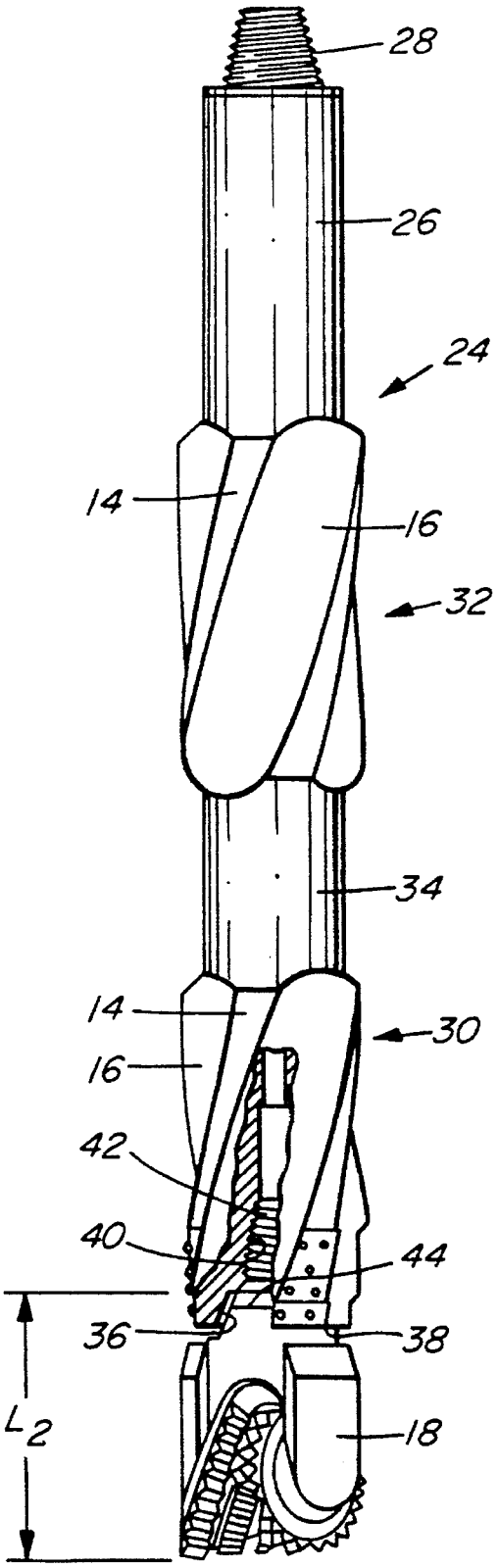
FIG. 2 is an elevational view showing a combined reamer and stabilizer assembly according to one embodiment of the present invention with a drill bit attached thereto.

A combined reamer and stabilizer assembly 24 according to one embodiment of the present invention is shown in FIG. 2. The assembly is formed of an integral solid heat treated steel shaft 26 which has been hardened and has a threaded shank 28 at the top thereof for connection to a drill string (not shown). The assembly 24 has a lower stabilizer 30 and an upper stabilizer 32 with a tong arm neck 34 for wrapping a chain around and gripping the assembly 24. The upper stabilizer 32 and lower stabilizer 30 both have raised spiral lands 14 and spiral depressed flutes 16 and the outside diameter of the lands 14 represents the nominal size of the drill bit. Thus, the two stabilizers ensure that a straight hole is drilled. In other embodiments, wherein a designed angle or curve is to be drilled, then the diameters of the stabilizers 30 and 32 may be changed to suit a particular drill program.

Figure 3:
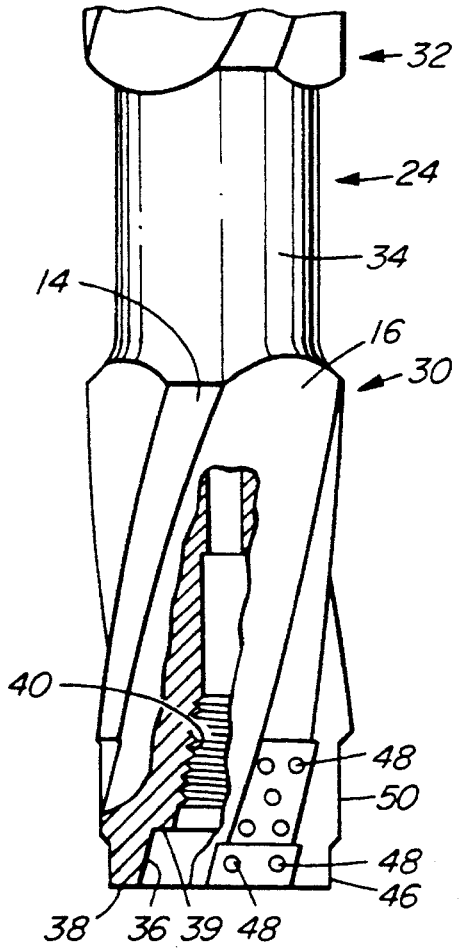
FIG. 3 is a side view, partially in section, showing a lower stabilizer and reamer of the assembly shown in FIG. 2.
Figure 5:
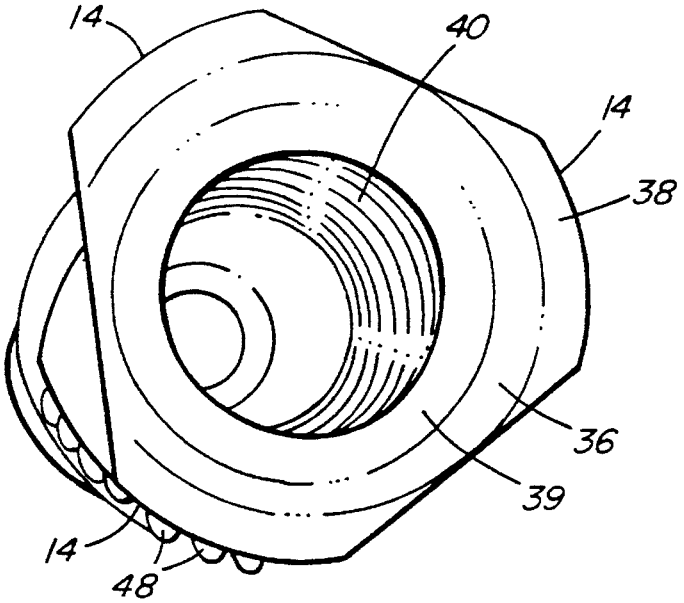
FIG. 5 is an end view showing the bottom of the combined reamer and stabilizer assembly shown in FIG. 2.

The connection of the drill bit 18 to the bottom end of the assembly 24 is illustrated in more detail in FIGS. 2, 3 and 5. As can be seen, there is an internally tapered lip 36 extending in from the bottom edge 38 of the assembly 24 leading to a shoulder 39 of an internally threaded box 40 into which the shank 42 of the drill bit 18 fits. The join or connection between the drill bit 18 and the assembly 24 occurs at the shoulder 39. As shown in FIG. 2, the shank 42 of the drill bit 18 fits into the internally threaded box 40 within the bottom on the assembly 24 and the flange portion 44 of the drill bit 18 rests on the shoulder 39 of the assembly 24 within the lip 36 of the assembly 24, thus the actual join between the drill bit 18 and the assembly 24 comes inside the lip 36 unlike the join 22 shown in FIG. 1. By reducing the dimension between the leading edge of the lower stabilizer 30 and the drill bit 18, there is less chance of deviation occurring during drilling.

Figure 4:
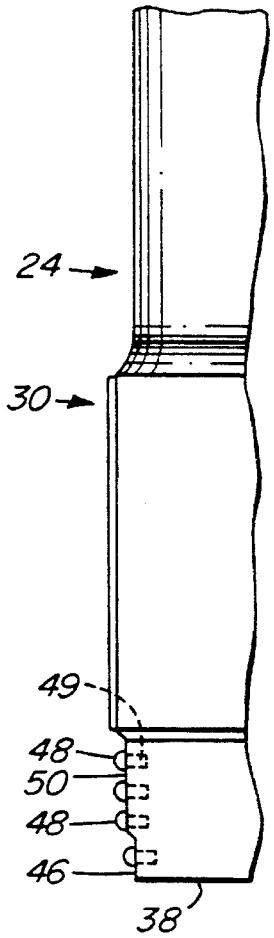
FIG. 4 is a partial side view showing a section through one of the lands of the assembly shown in FIG. 2.

As shown in FIGS. 3 and 4, the diameter of the spiral lands 14 of the lower stabilizer 30 represent the nominal size of the drill bit 18. A first cylindrical shoulder 46 on each land 14 from the leading edge or end 38 of the lower stabilizer 12 has a reduced diameter and mounted at each shoulder 46 are positioned two polycrystalline diamond layer inserts 48 of the type shown in U.S. Pat. No. 4,694,918. The polycrystalline diamond inserts are all dome shaped on top with a cylindrical body which is pressed into a radial hole 49 in the shoulder 46. The inserts 48 on the first cylindrical shoulder 46 project out to form a reaming diameter that is less than the gauge diameter of the hole. For example, if a 12 ¼ inch diameter hole is to be drilled, then the reaming diameter of the inserts 48 in the first shoulder 46 would be at approximately 11 ¾ inches, one-half inch less in diameter than the nominal size of the drill bit. A second cylindrical shoulder 50 is larger in diameter than the first shoulder 46 and extends from the first shoulder 46 of each land 14 to the commencement of the full gauge lands 14. The second shoulder 50 has five polycrystalline diamond layer inserts 48 positioned therein. These inserts 48 are exactly the same as the type shown in the first layer and are shown in three specific circumferential positions. The reaming diameter of the inserts 48 in the second shoulder 50 is substantially the same as the nominal size of the drill bit 18 and substantially the same as the diameter of the lands 14 in both the lower stabilizer 30 and the upper stabilizer 32.

Thus, in operation, the drill bit 18 is positioned as close as possible to the reamer portion of the lower stabilizer 30 formed with the polycrystalline diamond layer inserts 48. By having the overlapping connection between the drill bit 18 and the assembly 24, one achieves this closeness between the drill bit 18 and the assembly 24.

When the drill bit 18 is at the nominal size diameter, little reaming is required by the reaming section of the lower stabilizer 30. The stabilizer lands 14 maintain the straightness of drilling. However, it is known when drilling a hole that most drill holes are not exactly round due to the difference in rock formation, ground conditions, and many variables. Thus, the reamer portion with the polycrystalline diamond layer inserts 48 ensures that as the drill bit 18 moves downward, the drilled hole is reamed out to the nominal size of the drill bit 18. As the drill bit 18 wears and the drilling diameter is reduced, then the polycrystalline diamond layer inserts 48 commence to ream the drilled hole to ensure that the hole remains at the nominal drill size throughout the drilling operation. When the drill bit 18 is worn to a diameter of for example half an inch less than nominal size, then the inserts 48 on the first shoulder 46 commence the first reaming operation and the inserts 48 on the second shoulder 50 provide a second stage reaming to ensure that the drilled hole is fully reamed out to the nominal size.

Thus, when the drill bit 18 is worn and has to be replaced, it is raised to the drill head and replaced and reinserted, the drilled hole does not have to be reamed out because the reamer portion of the lower stabilizer 30 has kept the drilled hole at the nominal drill size. Considerable saving in time is therefore achieved and it has been found that drilled holes can be drilled faster than in the past.

In the embodiment shown, three lands 14 and three flutes 16 are shown. This is normal for stabilizer sections, however, this number may be varied. The lands have hardened surfaces to ensure that the drill bit is stabilized and drills in a substantially straight line when drilling through very hard rock formations. The stabilizers 30,32 provide substantial contact with the drilled hole wall and hold deviation to a minimum.

Various changes may be made to the embodiments shown herein without departing from the scope of the present invention which is limited only by the following claims.

The embodiments of the present invention in which an exclusive property or privilege is claimed are defined as follows:

1. A combined reamer and stabilizer assembly for a drill bit having a nominal size comprising:

a longitudinal shaft with a shank on a top end for connection to a drilling string;

an internally threaded box in a bottom end of the longitudinal shaft for connection to a drill bit, the internally threaded box having an internally tapered lip extending inwardly to overlap a drill bit shank, and a lower stabilizer having spiral flutes and lands adjacent the bottom end of the shaft, the spiral lands having polycrystalline diamond layer inserts at a leading edge of the stabilizer to provide a reamer, the inserts projecting outwardly from the spiral lands and adapted to ream a hole substantially the same size as the nominal size of the drill bit, said polycrystalline diamond layer inserts being positioned on a first shoulder of the spiral lands at the leading edge of the lower stabilizer to ream a hole less than the nominal size of the drill bit and positioned on a second shoulder between the first shoulder and the remaining portion of the lands of the lower stabilizer to ream a hole substantially the same size as the nominal size of the drill bit, the remaining portion of the lands of the lower stabilizer having an external diameter substantially the same as the nominal size of the drill bit.

2. The combined reamer and stabilizer assembly according to claim 1 wherein the lower stabilizer has three flutes and three lands and wherein there are two polycrystalline diamond layer inserts on the first shoulder of each land to rotate on one circle and five polycrystalline diamond layer inserts on the second shoulder of each land to rotate on three circles.

3. The combined reamer and stabilizer assembly according to claim 1 including an upper stabilizer spaced above the lower stabilizer with a tong arm neck on the shaft between the lower stabilizer and the upper stabilizer.

4. The combined reamer and stabilizer assembly according to claim 3 wherein the upper stabilizer has an external diameter substantially the same as the nominal size of the drill bit.

5. The combined reamer and stabilizer assembly according to claim 4 wherein the lower stabilizer, tong arm neck, and upper stabilizer are formed integrally in one assembly.

6. The combined reamer and stabilizer assembly according to claim 1 wherein the polycrystalline diamond layer inserts are dome shaped and press fit into radial holes in the lands.

* * * * *